United States Patent [19]

Reinwald et al.

[11] 4,255,148

[45] Mar. 10, 1981

Best Available Copy

[54] PROCESS AND APPARATUS FOR MACHINE WASHING AND CLEANING WITH LOW-PHOSPHATE OR PHOSPHATE-FREE WASHING SOLUTIONS

[75] Inventors: Elmar Reinwald, Dusseldorf-Holthausen; Milan J. Schwuger, Haan; Heinz Smolka, Langenfeld; Peter Krings, Krefeld, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 872,561

[22] Filed: Jan. 26, 1978

Related U.S. Application Data

[63] Continuation of Ser. No. 618,461, Oct. 1, 1975, abandoned.

[30] Foreign Application Priority Data

Oct. 3, 1974 [AT] Austria ..... 7969/74

[51] Int. Cl.[3] ..... B08B 3/00

[52] U.S. Cl. ..... 8/137; 252/130; 252/140; 252/179

[58] Field of Search ..... 8/137; 252/89 R, 542, 252/130, 140, 179

[56] References Cited

U.S. PATENT DOCUMENTS

| | | | |
|---|---|---|---|
| 3,424,545 | 1/1969 | Bauman | 8/137 |
| 3,925,262 | 12/1975 | Laughlin | 252/526 |
| 4,066,393 | 1/1978 | Morey | 8/137 |
| 4,083,793 | 4/1978 | Jakobi | 252/179 |
| 4,121,903 | 10/1978 | Smolka | 8/137 |

FOREIGN PATENT DOCUMENTS 2055423 5/1972 Fed. Rep. of Germany .

*Primary Examiner*—Paul R. Michl
*Attorney, Agent, or Firm*—Hammond & Littell, Weissenberger and Muserlian

[57] ABSTRACT

The machine washing of solid textiles or dishes is improved when the wash water is passed through a cation exchange agent of the formula:

$$(M_{2/n}O)_x \cdot Me_2O_3 \cdot (SiO_2)_y,$$

wherein M is a cation of valence n interchangeable with calcium, Me is a member selected from aluminum and boron, x is a number from 0.7 to 1.5 and y is a number from 0.8 to 6, said agent having a calcium binding power of at least 50 mg. of CaO per gram, said agent being maintained during said washing out of contact with the objects being washed within a filter apparatus. Apparatus for carrying out the process includes means for circulating the wash water through a vessel containing the cation exchange agent in porous solid or in fluidized bed form within a filter means.

12 Claims, 7 Drawing Figures

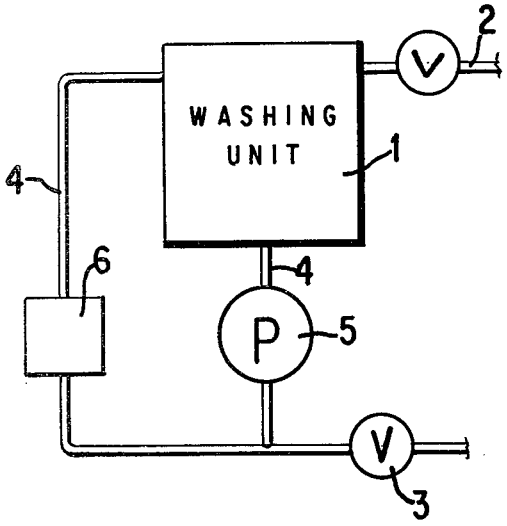
FIG. I
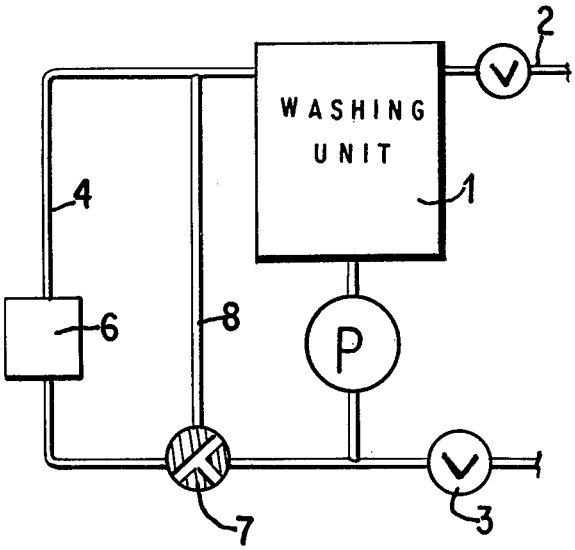
FIG. II
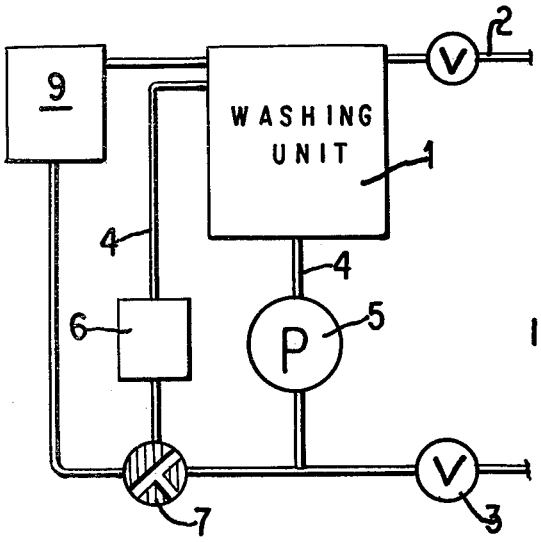
FIG. III
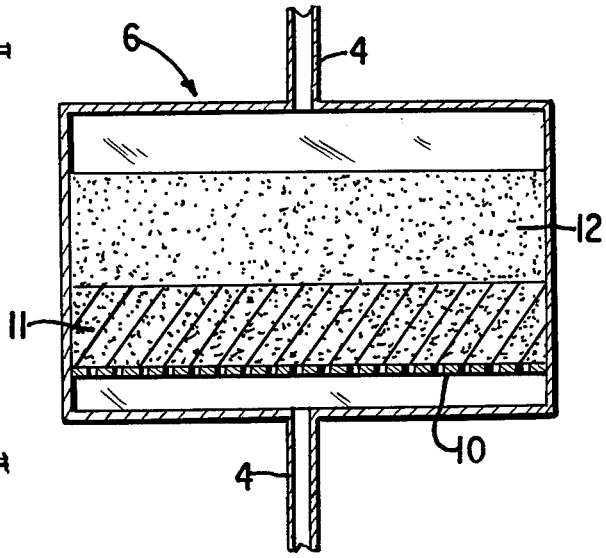
FIG. IV

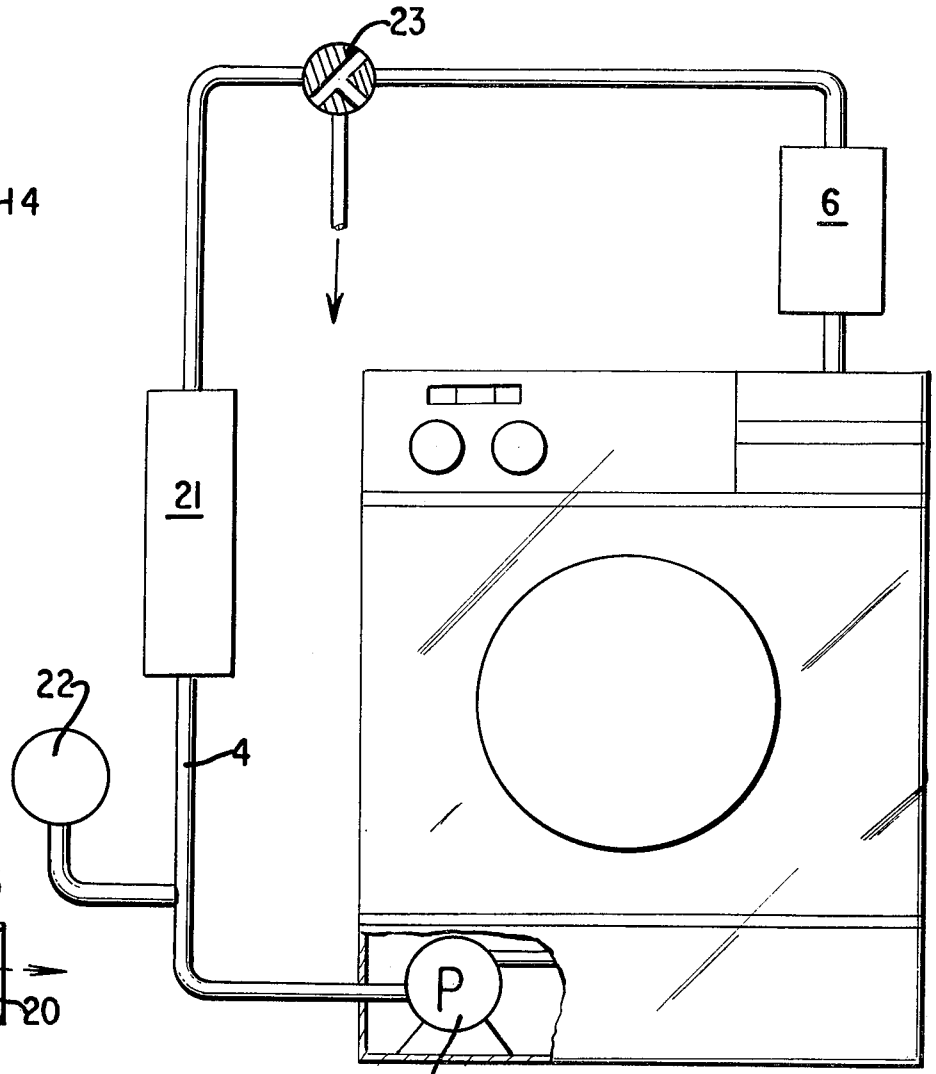
FIG. VI
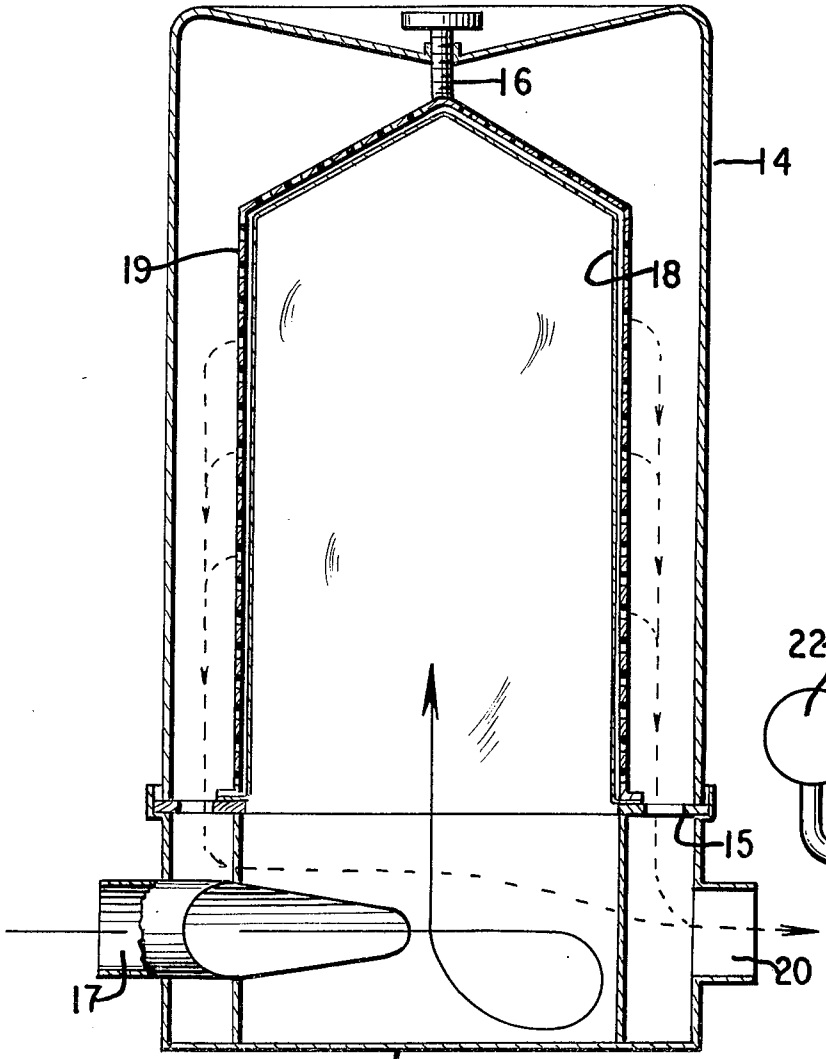
FIG. V

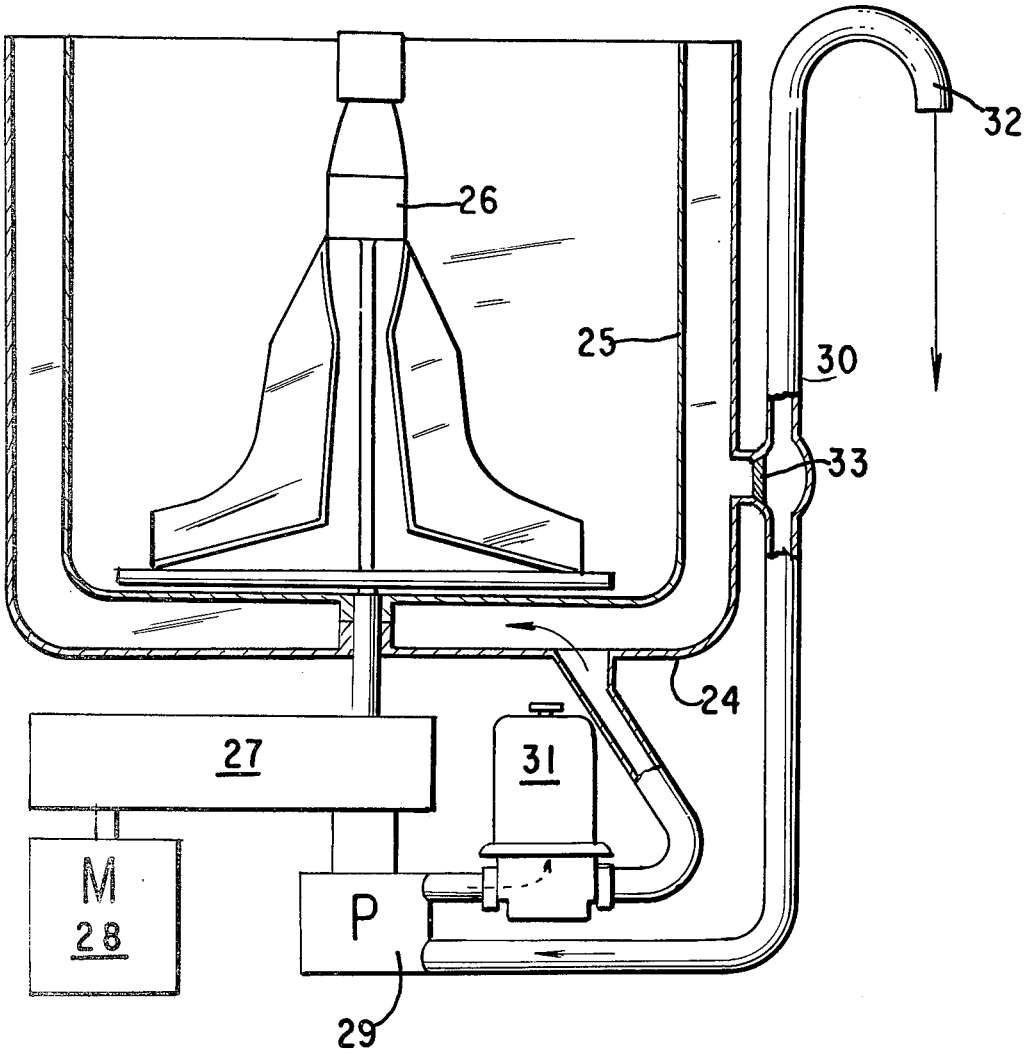
FIG. VII

PROCESS AND APPARATUS FOR MACHINE WASHING AND CLEANING WITH LOW-PHOSPHATE OR PHOSPHATE-FREE WASHING SOLUTIONS

This is a continuation of Ser. No. 618,461, filed Oct. 1, 1975, abandoned.

BACKGROUND OF THE INVENTION

The present invention relates to the washing of objects to remove soil therefrom, and is particularly directed at a method for improving the machine washing of clothes made out of woven textiles wherein the make-up water is more or less hard by a process of removing the hardness-forming cations therefrom. The invention involves a method for rapidly decreasing the hardness of the water during the washing cycle without depositing insoluble granular material in the clothes and without interfering with the action of anionic and non-ionic detergents. The invention includes apparatus suitable for performing the process, comprising a specially effective zeolite adapted to remove hardness-forming cations.

RELATED ART

Washing methods are known where the washing solution is circulated continuously during the washing process and conducted through one or more vessels in which the entrained dirt particles can settle from the wash water liquor before it is returned into the washing process. It has already been suggested to place screens or filters in the liquid circuit to retain coarse impurities or objects which could damage the mechanism. But since the bulk of the dirt is usually dissolved or dispersed in very finely divided form in the solution, the cleaning or regeneration of the solution is inadequate this way, and savings in certain washing and cleaning ingredients, for example, polymer phosphates, can not be achieved without a simultaneous decrease in the cleaning results.

In commercial laundries it is customary to prepare the washing solution with softened water, to which end the water to be used is first treated with an ion-exchange compound (e.g., a zeolite). But soft water does not have sufficient washing power, even in the presence of surface-active substances.

The problem is particularly serious when the articles to be washed carry soil which contains hardness formers, as pre-treatment of the wash water does not affect the hardness thereby introduced. This results in progressive incrustation of the material being washed.

Furthermore it has been suggested to effect the washing process in the presence of ion-exchangers based on organic polymers, which are added to the washing solution either in the form of a textile or as granular or powdered resins. But textile-type ion-exchangers have only a relatively low ion exchange capacity, so that large amounts of the ion-exchange textile are required. Almost any amount of hardness is detrimental to washing solutions which contain an anionic detergent, and in most areas where hardness is a significant problem it is necessary to decrease the hardness of the water by at least 50%. The space occupied by the ion-exchanger is at the expense of the material to be cleaned. Granular or powdered ion-exchange agents become caught in fabrics or garments being washed unless special precautions are taken, and the particles are difficult to recover when the washing operation is completed. If, as has likewise been suggested, the ion exchange resin is enclosed in a gauze bag to prevent the agent from depositing on the textile fibers, the cleaning effect of the washing solution is considerably decreased.

A method, as well as a device for carrying out this method, has now been found where these drawbacks are avoided and which yields an above-average cleaning result, even when phosphates are not present or when they are present only in small amounts.

U.S. Patent application Ser. Nos. 458,306 filed on Apr. 5, 1974 now abandoned in favor of continuation Ser. No. 800,308, filed May 5, 1977, now abandoned in favor of continuation-in-part Ser. No. 956,851, filed Nov. 2, 1978, by Schwuger et al. and 446,153 filed on Feb. 27, 1974, now abandoned in favor of divisional Ser. No. 680,777, filed Apr. 27, 1976, and now abandoned by Krings et al. disclose that the cleansing effected in the machine washing of laundry with detergent solutions is greatly improved when washing solutions have a uniformly distributed content of certain finely-divided ion-exchange aluminosilicates. It was found that these silicates have the capability of rapidly binding not only the calcium hardness ions which are normally present in the make-up water, but that they also have the capability of rapidly binding the hardness-imparting ions which become present in the water as the calcium-containing soil in the garments is solubilized. It was believed, however, that to inactivate the calcium ions solubilized from the soil before these ions could react with and precipitate the anionic detergents usually present in the washing solution, the aluminosilicate must be present in direct or virtually direct contact with the fibers as the washing operation proceeded. It was seen that as a result, a considerable number of these particles became deposited within the textile fibers and in the pockets and seams of the garments, and this was a disadvantage of the process.

OBJECTS OF THE INVENTION

An object of the invention is a method for the machine washing and cleaning of solid materials (including garments made from textiles) with the use of solutions which contain low-phosphate or phosphate-free washing and cleaning agents in the presence of water-insoluble cation exchange agents which are capable of binding the hardness formers of the water and of the impurities and which can be conveniently removed.

A further object is to provide such a method which will avoid depositing particles of an insoluble ion-exchange agent in the fibrous structure of a textile or in the seams, pockets, and similar places of garments constructed of textiles.

A still further object is to provide such a method by use of an ion-exchange agent in apparently solid, bulk form, or in the form of free-flowing granules or as a powder.

An additional object is to provide simple and inexpensive apparatus for performing the above-describe process, suitable for use in the home.

DESCRIPTION OF THE INVENTION

The discovery has now been made that very substantial improvements in the amount of soil which is removed during a given washing occur when the aluminosilicate agent is not necessarily finely divided, and even when the aluminosilicate is not in the immediate presence of the garments or other objects which are being washed. We have found that the bindive capacity of the above-described aluminosilicates is so strong that the aluminosilicate can be concentrated in one part of the washing system in particulate and even in solid bulk form, restrained by a filter, and yet it can decrease the hardness of the aqueous washing solution to such an extent that the detergency of anionics tensides is no more than negligibly impaired even when the make-up water for the washing possesses a high degree of hardness and the garments carry a substantial amount of hardness-imparting soil.

The present invention thus permits the aluminosilicate to be localized apart from the articles which are washed. When the articles washed are clothes, this discovery is important because it permits the water to be decreased in hardness by virtually any desired amount without introducing particles of the calcium binder into the clothes.

We have discovered that the foregoing can be accomplished by contacting the washing solution used for the machines washing of various soiled objects including textiles and garments constructed of textiles during the washing cycle with a sufficient amount of a cation-exchange agent of the formula:

$$(M_{2/n}O)_x.Me_2O_3.(SiO_2)_y$$

wherein M is a cation of valence n, interchangeable with calcium, Me is a member selected from aluminum and boron, x is a number from 0.7 to 1.5, and y is a number from 0.8 to 6, said agent having a binding capacity for calcium ions equivalent to at least to at least 50 mg of CaO per gram, to soften said solution significantly during said washing, substantially all of said agent being maintained during said washing out of contact with the objects being washed within a filter element or the equivalent.

We have found that this can be accomplished by use of the cation exchange agent at a mean particle size of more than 20$\mu$ in the form of a bed; the washing solution being pumped through the bed continuously or intermittently as the washing proceeds and the agent being in a separate vessel restrained by a filter element. We have found that by this means the calcium hardness of the solution can be decreased by more than 50% and if desired maintained at a negligibly low level. The bed may be a static bed composed of agglomerated particles of the ion exchange agent, and the agent may be in the form of a solid, porous block, in which event the block acts as a filter. The bed may also be a fluidized bed, in which event the cation exchange agent is present in finely divided form and the particles are maintained in aqueous suspension in a vessel apart from the objects being washed. The particles may be surrounded by a porous envelope or element, which acts as a filter. We have found that the method works well when the washing solution contains conventional additives and particularly when the solution contains an anionic detergent and 0.5 g./l. to 2 g./l. of a water-soluble sequestering agent for calcium as an assistant or adjuvant for the ion exchange agent.

It is usually necessary that the amount of cationic exchange zeolite used be sufficient to bind at least about half of the hardness present.

We have found that the process can be performed in a conventional machine washers which comprise in combination a tub adapted to contain the objects to be washed, a conduit having a pump therein adapted to circulate washing solution from one portion of the tub to another portion of said tub, and a vessel in said conduit adapted to contain said ion exchange agent having a particle size in excess of 0.1$\mu$. The vessel may be a static bed filter or a filter of the fluid bed type, containing the ion exchanger in one of the forms described above. The vessel is hereinafter sometimes for convenience termed a "filter", but it will be understood that in each instance it also perform the function of binding the ions which cause hardness in water.

The method of the present invention is characterized in that the cation-exchanger has a calcium binding capacity of at least 50 mg. CaO/g. and consists of a compound (which may contain water of hydration), of the formula:

$$(M_{2/n}O)_x.Me_2O_3.(SiO_2)_y$$

wherein M denotes a water-soluble cation of valence n exchangeable with calcium, x denotes a number from 0.7 to 1.5, Me denotes boron or aluminum, and y denotes a number from 0.8 to 6, and that the washing solution is conducted continuously or intermittently through a filter which is suitable for maintaining the cation exchanger separate from the washing solution.

Compounds in which Me=Al and y=1.3 to 3.3 are preferred. Their calcium binding capacity is preferably 100 to 200 mg. CaO/g. They are hereafter called "aluminosilicates" for brevity.

As cation sodium is preferred, followed by lithium, potassium, ammonium or magnesium, as well as the cation of water-soluble organic bases, e.g. those of primary, secondary or tertiary amines or alkylolamines with not more than two-carbon atoms per alkyl radical, or not more than three carbon atoms per alkylol radical.

Aluminosilicates of the type described above are commercially available and are produced synthetically in a simple manner, for example, by reacting water-soluble silicates with water-soluble aluminates in the presence of water. Thus, aqueous solutions of the starting materials can be mixed with each other, or one component which is present in solid form can be reacted with the other component which is present as in dissolved state. By mixing both components in solid form we also obtain the desired aluminosilicates. Aluminosilicates can also be obtained from $Al(OH)_3$, $Al_2O_3$ or $SiO_2$ by reacting them with alkali silicate- or aluminate solutions, respectively. Particularly effective aluminosilicates are formed if the special precipitation conditions are observed which are described in detail in said copending application Ser. No. 458,306. In similar manner the boron analogues can be formed.

The aluminosilicates produced by precipitation or transformed in finely divided form into aqueous suspension by other methods can be transformed by heating to temperatures of 50° to 200° C. from the amorphous into the aged or crystalline state. Crystalline aluminosilicates are preferred for the purposes of the invention. Particularly suitable are the aluminosilicates of the composition:

$$0.7\text{–}1.1Na_2O.Al_2O_3.1.3\text{–}3.3SiO_2.$$

The amorphous or crystalline aluminosilicate which is present in aqueous suspension can be separated by filtration from the remaining aqueous solution and dried at temperatures of 50° to 400° C. (preferably 80° to 200°

C.). The product after drying contains more or less bound water.

The water-containing aluminosilicates thus produced after the disintegration of the dried filter cake are obtained as a fine powder whose primary particle size does not exceed 0.1 mm, but which is mostly less, down to dust fineness, e.g. down to 0.1μ. It must be kept in mind that the primary particles can be agglomerated to larger structures. If finely divided aluminosilicates are desired, for example, those which consist at least 80% by weight of particles of the order of magnitude of 30 to 0.1μ, the formation of larger particles can be prevented by applying high shearing forces while bringing the aluminate- and silicate solution together or during the precipitation process. Aluminosilicates of this fineness do not tend to get caught in the textile fabric and can therefore be brought directly in contact with the material to be washed or with the objects to be cleaned. By the process of the invention, coarse grained agglomerated or pelletized aluminosilicates can also be used. Care must be taken that only the circulated washing or cleaning liquid comes in contact with the aluminosilicate, which can be achieved by a suitable arrangement or design of the filter or e.g. by use of the fluid bed "whirlpool" filter.

If the aluminosilicate is added to the wash liquor as a component of the detergents or simultaneously with the latter and is thus brought in direct contact with the substrate (called hereafter "contact method") the particle size should be between 5 and 40μ, preferably 10 and 30μ. If the particle size is substantially less than 5μ in this embodiment, the aluminosilicate is difficult to filter, and there is a possibility that the filter pores will be partly clogged. Material with a particle size of substantially over 40μ is easy to filter, but complete removal of the coarse-grained portions from the textile material is difficult.

Preferably a procedure is used when the aluminosilicate is not brought directly in contact with the substrate, but only with the wash liquor (hereafter called "flow-through method"), and where the particle size is preferably in the interest of good filtering capacity above 20μ, particularly above 30μ. The upper limit of the particle size is determined exclusively by the penetrability of the material, that is, it is lower for compact grains than for porous particles with a large active surface. With sufficient penetrability, the aluminosilicates can also be present in lump form. Finally with sufficient penetrability the material can also be designed as a filter cartridge or filter plate so that the use of a separate filter is not necessary. Such lumpy or shaped, porous or easily penetrable aluminosilicates are obtained, for example, by cementing or agglomerating the crystallites with an inorganic binder, shaping and hardening or sintering.

Another method of improving the filtering capacity of the aluminosilicates, if desired, consists in using filter aids, like kieselguhr (silica), diatomaceous earth, pumice powder, cellulose, or finely ground plastic foam. The aluminosilicate can also be deposited or adsorbed on these porous materials, improving the filtering capacity during the production or after in order to increase this way the particle size.

Clogging of the filter when using finely divided aluminosilicates can also be prevented and at the same time the washing process can be accelerated and the cleaning result improved and the exchanger capacity better utilized by keeping the aluminosilicate constantly in motion inside the filter, for example, by recycling the cleaning solution intermittently or repeatedly, and by reversing its direction of flow during the washing process. Preferably a so-called "whirlpool bed filter" is used for the purpose where the turbulence of the filter contents (the ion exchange zeolite in particulate form) is increased by suitable design of the filter, the filter vessel, or of the feed lines. If the washing is effected with the calcium exchanger uniformly suspended in the washing solution with periodic flow reversals of the washing solution, reversal of the flow should be discontinued when washing is complete so that the suspended aluminosilicate particles and the suspended soil can be separated as completely as possible from the textile material and collected in the filter.

The process of the present invention is ordinarly used with waters which have a normal hardness in excess of about 75 mg/l of CaO equivalent, i.e., with waters which have an initial hardness of the amount of which develop this hardness as the washing proceeds.

The amount of aluminosilicate required to obtain a good washing- or cleaning effect depends, on the one hand, on its calcium binding power, and on the other hand, on the amount of dirt in the materials to be washed and on the hardness and the amount of water used. The amount of aluminosilicate should be so determined that the residual hardness of the water (i.e., the hardness after the washing is completed) does not exceed 5° dH (German hardness; corresponding to 50 mg. CaO/l.), preferably 0.5° to 2° dH (5 to 20 mg. CaO/l). In order to obtain an optimum washing or cleaning effect, it is advisable to use a certain excess of aluminosilicate, particularly in the case of greatly soiled substrates, in order to completely or partly bind the hardness formers contained in the released dirt. In most instances, accordingly the amount used per cleaning cycle range between 0.2 to 10 g. of aluminosilicate, particularly 1 to 6 g. of aluminosilicate per liter of wash water, so as to maintain the hardness of the wash solution as close to zero as is practicable.

It was also found that the dirt can be removed much faster and/or more completely if a water-soluble substance is added to the treatment water which exerts a sequestering (i.e., a complex-forming) and/or precipitating effect on the calcium contained in the water as a hardness former. Suitable as sequestering agents for calcium for the purposes of the invention are also substances with such a low sequestering power that they were not considered heretofore as typical sequestering agents for calcium, but these compounds are frequently capable of delaying the precipitation of calcium carbonate from aqueous solutions. The sequestrants or precipitants binding calcium ions can be present in substoichiometric amounts, related to the hardness formers present. They act as "carriers", that is, their calcium salts are transformed into soluble salts by contact with the ion-exchanger and they are thus again available as sequestrants.

Preferably small amounts of sequestrants or precipitants for calcium are used, e.g. 0.05–2 g/l. in order to speed up or improve the removal of impurities. Particularly amounts of 0.1–1 g/l. are used. Substantially larger amounts can also be used, but in the case of phosphorus sequestrants or precipitants the amounts should be so selected that the phosphorus load of the waste water is less than with the use the customary detergents based on tripolyphosphate.

The sequestrants or precipitants comprise those of an inorganic nature like the water-soluble alkali metal (particularly the sodium) and ammonium pyrophosphates, tripolyphosphates, higher polyphosphates, and metaphosphates.

Organic compounds which act as sequestrants or precipitants for calcium include the water-soluble polycarboxylic acids, hydroxycarboxy acids, aminocarboxy acids, carboxyalkyl ethers, polyanionic polymers and water-soluble salts thereof, particularly the polymeric carboxylic acids and the phosphonic acids, which are used as acids, alkali- or aluminum salts and preferably as sodium salts.

Examples of polycarboxylic acids are dicarboxylic acids of the general formula $HOOC—(CH_2)_n—COOH$ wherein n=0 to 8, in addition maleic acid methylenemalonic acid, citraconic acid, mesaconic acid, itaconic acid, noncyclic polycarboxylic acids with an least three carboxyl groups in the molecule, such as for example tricarballylic acid, aconitic acid, ethylene tetracarboxylic acid, 1,1,3,3-propanetetracarboxylic acid, 1,1,3,3,5,5-pentanehexacarboxylic acid, hexanehexacarboxylic acid, cyclic di- or polycarboxylic acids such as for example, cyclopentanetetracarboxylic acid, cyclohexanehexacarboxylic acid, tetrahydrofurantetracarboxylic acid, phthalic acid, terephthalic acid, benzene-tri-, tetra- or pentacarboxylic acid, as well as mellitic acid.

Examples of hydroxymono or -polycarboxylic acids are glycolic acid, lactic acid, malic acid, tartronic acid, methyl tartronic acid, gluconic acid, glyceric acid, citric acid, tartaric acid, and salicylic acid.

Examples of aminocarboxylic acids are glycin, glycolglycin, alanin, asparagin, glutamic acid, aminobenzoic acid, iminodi- or triacetic acid, (hydroxyethyl) iminodiacetic acid, ethylenediaminetetraacetic acid, (hydroxethyl)-ethylenediaminetriacetic acid, diethylenetriaminepentaacetic acid, as well as higher homologues, which can be obtained by polymerization of a N-aziridylcarboxylic acid derivative, e.g. acetic acid, succinic acid, tricarballylic acid and subsequent saponification or by condensation of polyamines with a molecular weight of 500 to 10,000 with salts of chloroacetic or bromoacetic acid.

Examples of carboxyalkyl ethers are 2,2-oxydisuccinic acid and other ether polycarboxylic acids, particularly polycarboxylic acids containing carboxymethyl ether groups which comprise corresponding derivatives of the following polyvalent alcohols or hydroxycarboxylic acids, which can be completely or partly etherified with the glycolic acid: glycol, di- or triglycols, glycerin, di- or triglycerin, glycerin monomethyl ether, 2,2-dihydroxymethyl-propanol, (1,1,1-trihydroxymethyl) ethane, (1,1,1-trihydroxymethyl)propane, erythrite, pentaerythrite, glycolic acid, lactic acid, tartaonic acid, methyltartronic acid, glyceric acid, erythronic acid, malic acid, citric acid, tartaric acid, trihydroxy glutaric acid, saccharic acid, and mucic acid.

As transition types to the polymeric carboxylic acids we mention the carboxymethyl ethers of sugar, starch and cellulose.

Among the polymeric carboxylic acids, the polymers of acrylic acid, hydroxyacrylic acid, maleic acid, itaconic acid, mesaconic acid, aconitic acid, methylene malonic acid, citraconic acid, etc., the copolymers of the above-mentioned carboxylic acids with each other or with ethylenically-unsaturated compounds like ethylene, propylene, isobutylene, vinyl alcohol, vinyl methyl ether, furan, acrolein, vinyl acetate, acrylamide, acrylonitrile, methacrylic acid, crotonic acid, etc. such as the 1:1 copolymers of maleic anhydride and ethylene or propylene or furan, play a special role.

Other polymeric carboxylic acids of the type of the polyhydroxypolycarboxylic acids or polyaldehydopolycarboxylic acids are substantially substances composed of acrylic acid- and acrolein units or acrylic acid- and vinyl alcohol units which can be obtained by copolymerization of acrylic acid and acrolein or by polymerization of acrolein and subsequent Cannizzaro reaction, if necessary, in the presence of formaldehyde.

Examples of phosphorus-containing organic sequestrants are alkane-polyphosphonic acid, amine- and hydroxyalkane polyphosphonic acids and phosphono-carboxylic acids, such as the compounds methane diphosphonic acid, propane-1,2,3-triphosphonic acid, butane-1,2,3,4-tetraphosphonic acid, polyvinyl phosphonic acid, 1-amino-ethane-1, 1-diphosphonic acid, 1-aminomethane-1-phenyl-1, 1-diphosphonic acid, aminotrimethylene phosphonic acid, methylamino- or ethylamine dimethylene phosphonic acid, ethylenediaminotetramethylene phosphonic acid, 1-hydroxyethane-1, 1-diphosphonic acid, phosphonoacetic acid, phosphonopropionic acid, 1-phosphonoethane-1,2-dicarboxylic acid, 2-phosphonopropane-2,3-dicarboxylic acid, 2-phosphonobutane-1,2,4-tricarboxylic acid, 2-phosphonobutane-2,3,4-tricarboxylic acid as well as copolymers of vinyl phosphonic acid and acrylic acid.

The process of the present invention permits a reduction in the use of phosphorus containing inorganic or organic sequestrants or precipitants to a content of inorganically or organically combined phosphorus in the treatment liquors of less than 0.6 g./l., and preferably of less than 0.3 g./l. or the working of the process completely without phosphorus containing compounds.

The process of the present invention is usefully applied to waters of any given objectionable level of hardness.

Apart from washing textiles, which is the preferred field of application, the method and the device according to the invention are also suitable for any other cleaning operations where it is possible or of advantage to return or regenerate the cleaning solution. These applications comprise the cleaning of instruments, apparatus, pipe lines, boilers and vessels of any material like glass, ceramic material, enamel, metal or plastic. An example is the industrial cleaning of bottles, drums and tank cars. The method is also particularly suitable for use in commercial or household dishwashing machines.

Depending on the use, customary surfactants, builder-substances which increase the cleaning power, bleaching agents, as well as compounds which stabilize or activate such bleaching agents, greying inhibitors, optical brighteners, biocides or bacteriostatic substances, enzymes, suds-inhibitors, corrosion-inhibitors and substances regulating the pH value of the solution can be present in the washing and cleaning process. Such substances, which are normally present in varying amounts in the washing, rinsing and cleaning agents, are listed specifically in said patent application Ser. No. 458,306 and Ser. No. 446,153.

When using one or more of the above mentioned substances which are generally present in cleaning liquors, the following concentrations are preferably maintained:

0–2.5 g./l. surfactants
0.01–3 g./l. sequestrants
0–3 g./l. other builder substances 0–0.4 g./l. active oxygen or equivalent amounts of active chlorine The pH of the treatment liquors can range from 6 to 13, depending on the substrate to be washed or cleaned; preferably it is between 8.5 and 12.

The treatment temperature can vary within wide limits and is between 20° and 100° C. Since the washing and cleaning effect is already very high at low temperatures, that is between 30° and 40° C. and exceeds that of conventional detergents and methods, it is possible to wash very delicate fabrics in this range, e.g. those of wool or silk or very fine porcelain dishes with a very delicate overglaze or gold trim without damaging them.

The washing or cleaning time at the anticipated treatment temperature depends on the degree of soiling, the exchange rate, and the output of the pump. It can therefore vary within wide limits, for example, from five minutes or two hours. Preferably it is between 10 and 60 minutes, as this is usually sufficient to effect substantially complete removal of soil. The output of the pump and of the filter are preferably so selected that the cleaning solution is circulated at least twice. In the case of the contact method this is done preferably toward the end of the cleaning process. In the case of the flow-through method (the method of the present invention) the solution should pass at least five times and preferably ten to about 50 times through the filter charged with the aluminosilicate. This output should also be achieved if the filter is clogged by the deposited material and has become difficult to penetrate. It is therefore advisable to use pumps which still assure a sufficient output at a certain back-pressure, e.g. of 1–2 atmospheres above normal. Of advantage are filter arrangements where the trapped solids (including the aluminosilicates) are intensively whirled up so that there are no major deposits on the filters during the washing process. Such an arrangement ("whirlpool bed") unlike a fixed bed arrangement of the exchanger, permits shorter washing times and thus the use of smaller and constructionally less elaborate pumps. This effect can be further increased by intermitten operation or reversal of the direction of flow.

The pore size of the filter depends on the particle size of the aluminosilicate. Since the deposited material or the additionally used filter aid have also a filter effect, the pore size can be greater than corresponds to the particle size of the fine portions in the interest of a lower flow resistance. With a mean particle size of the aluminosilicate of 10 to 50$\mu$, the pore size of the filter can therefore be 50 to 150$\mu$, for example, preferably 80 to 120$\mu$, which also applies to the case where the particle size range is relatively wide and the fine portions are present in a particle size of less than 1$\mu$.

The filter element in the device containing the ion-exchange material can consist of any material, for example, paper, textile fabric, ceramic material, or ion exchange material itself. To advantage are used paper filters which are discarded together with the deposited ion exchange material as well as mechanical impurities and lint, or in dishwashing machines food remnants removed from the substrate or retained by the filter. The advantage is that new ion exchange material with a reproducible activity is used for each cleaning process. Neither the aluminosilicate nor the filter material as "pollution-free" garbage represent a burden for the garbage dumps and incinerators. On the other hand, the ion exchange material can be regenerated, which may be suitable for lumpy or shaped exchangers. Regeneration, when employed, is preferably effected with highly concentrated common salt solutions. Regeneration can also be effected with solutions of the above-mentioned sequestrants, but this is less advisable because of cost and because of the possible pollution of sewage by the spent solution.

The ion exchange filter can furthermore be so selected that substantially only the larger portions of the ion exchange material are retained, while the finest portions, particularly those with a particle size of less than 1$\mu$, remain in the cleaning solution and are eliminated with the latter after the conclusion of the washing process. Those fine portions form relatively stable dispersions which settle very slowly and which therefore do not lead to the formation of deposits on the materials to be cleaned or on the pipe lines, pumps and sewage pipes.

On the other hand in certain instances it is advantageous to retain even fine portions below 1$\mu$, for example, down to 0.1$\mu$, by correspondingly varying the dimensions of the adsorption means. In this case not only the aluminosilicate, but the suspended dirt particles are also practically completely separated. By this means the cleaning solution can be clarified to such an extent that it can be used again after recovery for a later washing or cleaning process without affecting its cleaning power. The necessary replacement of fresh water can be confined to the amount of water retained by the textile or other materials to be cleaned and by the adsorption device. The amount of water required for rinsing can also be considerably reduced, since washing out of the suspended dirt particles is eliminated and only the adsorbed or dissolved components of the washing- and cleaning agent have to be removed. In this way up to 80% water can be saved, compared to a conventional washing process. In a special embodiment, the removed and clarified cleaning solution can be conducted additionally over a carbon filter, which also completely or partly retains the dissolved surfactants. Without prior removal of the suspended dirt particles as it is accomplished by the method according to the invention, such a filter is soon exhausted and is uneconomical for use.

The device (i.e., the apparatus) according to the invention consists at least of the following components:

(a) A washing or cleaning unit which may be of a conventional or modified construction;

(b) A ring conduit equipped with a circulating pump, and (c) At least one unit akin to a filter unit in the ring conduit for containing the calcium binding agent.

The invention is further illustrated by the drawings, wherein:

FIGS. I, II and III are flow diagrams of processes according to the present invention;

FIGS. IV and V show schematically in section a fixed bed and a fluid bed filter suitable for use in the process and apparatus of invention, FIG. VI shows schematically an elevation of a machine washer according to the present invention, and FIG. VII shows a vertical section of another machine washer according to the present invention.

In the figures, the same numbers designate similar or equivalent components.

In FIG. I the apparatus consists of washing or cleaning unit 1 equipped with valved make-up water inlet 2, valved outlet 3, for discharge of the washing solution; and ring conduit 4, circulating pump 5, and vessel 6 for containing the calcium binding agent.

FIG. II illustrates a modification of the apparatus of FIG. 1 where the bulk of the circulated cleaning liquid is by-passed around binding agent vessel 6 and is thus returned directly into the cleaning unit. For this purpose ring conduit 4 is provided with three-way valve 7 and by-pass conduit 8 which thus permits part or virtually all of the wash water to be circulated through or around the vessel 6 containing the calcium binder. This arrangement is provided for those cleaning units where the mechanical treatment of the material to be cleaned is effected by the circulating cleaning liquor by means of stationary or movable spray nozzles, as it is customary, for example, in dishwashing machines or in washing apparatus with suspended textiles. A filter arranged in the main current would offer in these cases a too high resistance to the cleaning liquor. Valve 7 can be operated intermittently if desired. In continuous washing or spraying plants it is also possible to arrange two or more ion exchangers which are equipped with shutoff and draining devices. The filter with exhausted exchangers can then be replaced without having to interrupt the cleaning process.

FIG. III shows a modification of the apparatus of FIG. I to permit the cleaning solution in whole or in part to be stored for further use in the process. For this purpose vessel 6 is by-passed by three-way valve 7, conduit 4*a* and storage vessel 9 (for retaining the washing solution for subsequent re-use).

FIG. IV shows a vessel 6 containing the calcium ion binder in the form of a fixed bed suitable for use as calcium ion binder vessel 6 in FIGS. I, II and III. In FIG. IV, the vessel comprises porous retaining plate 10, filter aid 11 and deposited aluminosilicate 12.

FIG. V shows a vessel for retaining the calcium binder in fluid bed form, which usually provides better results. In FIG. V, the vessel comprises two-part housing having bottom 13, cover 14, sealing ring 15 and pressure screw 16. In operation, the wash liquor, the path of which is marked by arrows (unfiltered solid, filtered dashed lines), enters the vessel through inlet 17, vigorous turbulence being ensured by a suitable (for example, tangential) arrangement of the inlet. After passing through container bag 18, which can consist of paper or textile material, and perforated container 19, the liquor arrives in the outer jacket of the housing and flows from there into outlet connection 20. The vessel can be emptied and cleaned in a simple manner after bag 18 has been removed.

FIG. VI illustrates one form of apparatus suitable for performing the examples. The apparatus is a modified home laundry washing machine. In the machine, circulating pump 5 discharge through conduit 4 to flowmeter 21, three-way sampling valve 23 and calcium binder container 6. Conduit 4 is provided with manometer 22 which permits the back-pressure in the system to be determined. Sampling valve 23 permits the condition of the wash water to be observed during the washing process. For example, the degree of clouding or contamination of the treated washing solution can be determined.

FIG. VII illustrates another form of laundry machine washer, suitable for performing the examples. The apparatus here comprises a tub washing machine comprising tank 24, laundry basket 25, and beater cross 26 for mechanically agitating the wash. Basket 25 and cross 26 are driven through reversing gear 27 by motor 28. The same gear also drives circulatory pump 29. The circulated washing solution flows from the tank into ring conduit 30 to pump 29 and from there into vessel 31 for containing the calcium ion binder back into the tank 24. After the completion of the washing process, the washing solution is discharged through outlet 32 after reversing the pump, the non-return valve 33 being closed to prevent the washing solution from flowing back into the tank.

The invention is not limited to the arrangement represented here. Rather these can be supplemented and modified in many ways. The aluminosilicates used in the process of the present invention can be prepared in simple manner, for example, by reacting a water-soluble silicate with a water-soluble aluminate in appropriate proportions in the presence of water. Thus sodium aluminate solution diluted with deionized water is added to sodium silicate solution. The desired product precipitates. The product when dried at first is amorphous, but turns into a crystalline material after prolonged standing. The formation of large crystal aggregates is enhanced by standing. Vigorous stirring during the precipitation and recrystallization period leads to a finely divided product. After the liquor from the crystal sludge has been drained off and the sludge has been washed with deionized water until the outflowing wash water has a pH of about 10, the filter residue is dried. If necessary, the residue can be ground in a ball mill and separated in a centrifugal sifter into fractions of various particle size. The particle size distribution can be determined by means of a sedimentation balance.

The calcium binding power of the aluminosilicates is determined as follows:

1 g. of aluminosilicate was added to 1 liter of an aqueous solution containing 0.594 g. of $CaCl_2$ (=300 mg. CaO/l=30° dH) standardized with diluted NaOH to 10. Then the suspension was stirred vigorously for 15 minutes at a temperature of 22° C. (±2° C.). After filtering off the aluminosilicate, the residual hardness ("x") of the filtrate is determined. From this value the calcium binding capacity in mg. CaO/g. of active substances (=AS) is calculated according to the following formula:

(30−x).10, where an anhydrous product which had been heated for 1 hour at 800° C. is used as active substance.

The percentages indicated below are percent by weight.

| Production conditions for aluminosilicate A 1: | |
|---|---|
| Precipitation: | 2.985 kg. aluminate solution of the composition: 17.7% $Na_2O$, 15.8% $Al_2O_3$, 66.6% $H_2O$<br>0.15 kg. causticsoda<br>9.420 kg. water<br>2.445 kg. of a 25.8% sodium silicate solution freshly prepared from commercial waterglass and easily alkali-soluble silica of the composition: 1 $Na_2O$ . 6.0 $SiO_2$ |
| Crystallization: | 24 hours at 80° C. |
| Drying: | 24 hours at 100° C. |
| Composition: | 0.9 $Na_2O$ . 1 $Al_2O_3$ . 2.05 $SiO_2$ . 4.3 $H_2O$ (= 21.6% $H_2O$) |
| Degree of crystallization: | Fully crystalline. |
| Calcium binding capacity | 150 mg. CaO/g, of active substance. |

The primary particle sizes of the aluminosilicate range from 10 to 45μ with a maximum at 20–30μ.

| Production conditions for microcrystalline aluminosilicate A 2: | |
|---|---|
| Precipitation: | As in aluminosilicate Al |
| Crystallization | 8 hours at 90° C. with stirring |
| Drying | 24 hours at 100° C. |
| Composition | 0.9 $Na_2O$ . 1 $Al_2O_3$ . 2.04 $SiO_2$ . 4.3 $H_2O$ (= 21.6% $H_2O$) |
| Degree of crystallization | Fully crystalline. |
| Calcium binding capacity | 170 mg. of CaO/g. of active substance |

The particle size distribution of microstalline product A2, determined by sedimentation analysis, lay in the following range:

$>40\ \mu = 0\%$

Maximum particle size = 10 $\mu$ $5 - 20\ \mu = 90\%$

The invention is further illustrated by the examples which follow. These examples are best embodiments of the invention, and are not to be construed in limitation thereof.

EXAMPLES 1-3

The following illustrates the washing of a variety of fabrics carrying a variety of soil (including iron soil) in water having a high concentration of calcium hardness components and containing anionic detergents. The calcium exchanger was added as a powder and was removed by filtration. The washing was performed in a commercial washing machine (of the Lavamat SL type) modified as shown in FIG. VI, where the ion exchange vessel corresponds to that of FIG. IV. The filter aid used was diatomaceous earth. The washing solution contained (in grams per liter):

0.5 N n-dodecyl benzenesulfonate
0.17 Tallow alcohol ethoxylated with 14 mols of ethylene oxide
0.27 Na soap (tallow fatty acids/behenic acid=1:1)
0.015 Na ethylenediaminotetraacetate (EDTA)
0.25 Na silicate ($Na_2$:S:$O_2$=1:3.3)
0.11 Na carboxymethyl cellulose (Na CMC)
2.0 Sodium perborate tetrahydrate
0.15 Magnesium silicate
0.2 Sodiumsulfate The following additives were used:

| Formula | Amount | Description |
|---|---|---|
| (a) | 3.5 | Na tripolyphosphate |
| (b) | — | No other additives |
| (c) | 0.4 | Na tripolyphosphate |
| (d) | 0.4 | Na tripolyphosphate |
| | 0.4 | Na citrate |
| (e) | 5.0 | Aluminosilicate A2 |
| (f) | 5.0 | Aluminosilicate A2 |
| | 0.4 | Na tripolyphosphate |
| (g) | 5.0 | Aluminosilicate A2 |
| | 0.4 | Na tripolyphosphate |
| | 0.4 | Na citrate |

Formula (a) corresponds to a modern heavy duty detergent with a high phosphorus content.

The washing machine was loaded with 3 kg. of clean wash and two textile samples each (20×20 cm) of soiled cotton (C), soiled finished cotton (F.C.) and a soiled textile composed of a blend of 50% polyester and 50% finished cotton (P/C); the samples had been artificially soiled with skin fat, kaolin, iron oxide black, and carbon black. The tap water had a hardness of 16° dH. (160 mg. CaO/1); this stimulated the hardness impacted by calcium and similar ions in the soil of normally soiled garments. The amount of wash liquor was 20 liters, and the washing time was 40 minutes at 90° C. The The aluminosilicate powder was dispersed together with the detergents in the liquor and was left there during the washing process (contact method). After the completion of the washing process, the circulating pump was started and the washing solution was passed for 15 minutes through the calcium ion absorber. About 90% of the aluminosilicate remained on the filter. The balance was removed by rinsing the wash five times with fresh water.

The percent remission (i.e., cleaning) of the textile samples was determined by photometry. The results are compiled in Table 1. The abbreviation "P" denotes phosphate.

TABLE 1

| Formula | Characterization | % Remission C | F.C. | P/C. |
|---|---|---|---|---|
| a | Reference, high P | 79 | 70 | 67 |
| b | Reference, P-free | 57 | 57 | 52 |
| c | Reference, low P | 55 | 57 | 52 |
| d | Reference, low P | 57 | 58 | 54 |
| e | Example 1 P-free | 79 | 70 | 62 |
| f | Example 2 low P | 78 | 71 | 62 |
| g | Example 3 low P | 79 | 72 | 71 |

The results show that the washing effect of detergents with a high phosphate content is achieved or surpassed particularly if small amounts of additional sequestrants, for example, sodium citrate are present.

EXAMPLES 4-6

The following illustrates the process of the present invention by a method wherein the cation exchange agent is present in a fluidized bed, and the washing solution is pumped through the bed.

New procedures of Examples 1 to 3 were repeated, with these differences: the vessel for containing the ion exchange agent according to FIG. IV was replaced by a fluid bed (whirlpool) vessel according to FIG. V, and the aluminosilicate was introduced into this vessel so that it did not come in direct contact with the textile material (flow-through method). The coarse crystalline aluminosilicate A 1 was used in amount of 5 g/liter. The washing solution was circulated constantly through the fluid bed during the washing process. The circulation rate was 12 liters per minute and the washing time 40 minutes. The other operating conditions were the same. Results are compiled in Table 2. They show an even greater improvement.

TABLE 2

| Example | Formula | Builder Substance | % Remission C | F.C. | P/C |
|---|---|---|---|---|---|
| — | a | Without Al Silicate High P | 79 | 70 | 67 |
| — | b | Without Al Silicate P free | 57 | 58 | 54 |
| — | c | Without Al Silicate Low P | 55 | 58 | 54 |
| — | d | Without Al Silicate Low P | 57 | 58 | 56 |
| 4 | e | With Al Silicate P free | 80 | 73 | 71 |
| 5 | f | With Al Silicate Low P | 81 | 73 | 72 |
| 6 | g | With Al Silicate Low P | 81 | 74 | 72 |

EXAMPLES 7-9

In the detergent formulas according to Examples 1-6 dodecyl benzenesulfonate was replaced by the same amount of an ethoxylated oxoalcohol (the adduct of $C_{14}$–$C_{17}$ oxoalcohols with 12 mols of ethylene oxide) and the tallow alcohol ethoxylated with 14 moles ethylene oxide by the adduct of tallow alcohol with 5 mols of ethylene oxide. These detergent formulas containing exclusively non-ionic surfactants (designated with b', c' and d') are particularly suitable for low-phosphate detergents as well as for wash-and-wear textiles composed of finished cotton and blended fabrics. The other test conditions were the same as for Examples 4–6 (flow-through method). The results of the washing tests are compiled in Table 3. An increase of the washing action can be noticed, particularly in the finished cotton and in the blended fabrics.

TABLE 3

| Example | Formula | Builder Substance* | % Remission C | F.C. | P/C |
|---|---|---|---|---|---|
| — | e' | Without Al Silicate P free | 79 | 68 | 60 |
| — | f' | Without Al Silicate Low P | 80 | 71 | 74 |
| — | g' | Without Al Silicate Low P | 80 | 72 | 75 |
| 7 | e' | With Al Silicate P free | 82 | 78 | 78 |
| 8 | f' | With Al Silicate Low P | 82 | 78 | 78 |
| 9 | g' | With Al Silicate Low P | 82 | 78 | 78 |

*P = phosphorus

EXAMPLE 10

The procedure of Example 7 was repeated except that the detergents used were phosphate-free detergents b' and e' (with 5 g./l. of aluminosilicate) based on non-ionic surfactants. 5 g./liter of the finely crystalline aluminosilicate A2 was first added together with the detergent to the aqueous washing solution and the circulation, before the wash was put in, was constantly recirculated for five minutes through a vessel charged with a filter aid (kieselguhr, trade name "Celite") according to FIG. IV. During the washing process which was carried out at 90° C. for one hour, the washing solution was constantly circulated through the vessel. The washing solution issuing from the tank after completion of the washing process was substantially clear and free of suspended dirt and suspended matter. The wash was spun and subsequently rinsed three times, each time with 30 liters of water. The results of the test are shown in Table 4.

TABLE 4

| Formula (phosphate-free, non-ionic) | % Remission C. | F.C. | P/C |
|---|---|---|---|
| b' (without aluminosilicate) | 80 | 72 | 75 |
| c' (with aluminosilicate) | 83 | 80 | 78 |

EXAMPLES 11 and 12

The procedures of Examples 4 and 7 were repeated in a tub washing machine with whirlpool bed filter according to FIGS. V and VII, using the phosphate-free detergents b and b' and aluminosilicate Al. During the washing process (40 minutes at 90° C.), the liquor was pumped for two minutes over the filter and circulation was stopped for 15 seconds each time. The average output was 8 liters per minute. The other test conditions were unchanged. After the liquor was removed, the material was rinsed three times with tap water.

The results are shown in Table 5.

TABLE 5

| Formula (phosphate-free) | % Remission C. | F.C. | P/C |
|---|---|---|---|
| b Anionic, without aluminosilicate | 57 | 58 | 54 |
| e Anionic, with aluminosilicate | 80 | 73 | 71 |
| b' Non-ionic, without aluminosilicate | 79 | 72 | 73 |
| e' Non-ionic, with aluminosilicate | 82 | 80 | 78 |

We claim:

1. A method for machine washing and cleaning of soiled textiles utilizing washing and cleaning solutions essentially containing up to 2.5 gm/l of surface-active compounds, from 0.05 to 2 gm/l of water-soluble sequestering agents for calcium, as well as water-insoluble cation-exchange agents which are capable of binding the hardness components of the water and the soil, wherein said cation-exchange agent has a calcium binding capacity of from 100 to 200 mg of CaO/gm and consists of a crystalline compound of the formula $(M_2O)_x.Al_2O_3.(SiO_2)_y$ wherein M is lithium, sodium or potassium, x is a number from 0.7 to 1.1 and y is a number from 1.3 to 3.3, which contains bound water, and wherein said cation-exchange agent has an average particle size of more than 20μ and is not brought into contact with said soiled textiles in a washing area but is instead located in an external filter element, separate from said soiled textiles being washed in said washing area, which comprises agitating said soiled textiles in the presence of said washing and cleaning solution wherein the total amount of washing solution containing surfactants is continuously or intermittently cyclically circulated from said washing area through the external filter element charged with the cation-exchange agent, and then back to the washing area at least 5 times during the cleaning process, and where the amount of the cation-exchange agent is 0.2 gm to 10 gm per liter of washing solution.

2. A method according to claim 1 wherein the amount of said cation exchange agent is sufficient to decrease the hardness of the water by at least 50%.

3. A method according to claim 1 wherein the filter element is a static bed composed of agglomerated particles of said cation exchange agent.

4. A method according to claim 1 wherein said cation exchange agent is in the form of a fluidized bed.

5. A method according to claim 1 wherein said cation exchange agent has the formula $$(M_2O)_{0.7-1.5}.Al_2O_3.(SiO_2)_{1.3-3.3}.$$

6. A method according to claim 1 wherein said cation exchange agent is in crystalline form.

7. A method according to claim 1 wherein the washing solution contains an anionic detergent.

8. A method according to claim 1 wherein the washing solution contains 0.05 g./l. to 2 g./l. of a water-soluble sequestering agent for calcium.

9. A method according to claim 1, wherein the amount of said cation-exchange agent is so selected that the residual hardness of the washing solution is 5 to 20 mg CaO/liter.

10. A method according to claim 1, wherein the washing solution is passed through the cation-exchange agent from about 10 to 50 times during the cleaning process.

11. A method according to claim 1, wherein the washing and cleaning solutions are phosphate-poor or phosphate-free.

12. A method according to claim 1, wherein M is sodium.

* * * * *